United States Patent [19]

Kobayashi

[11] Patent Number: 4,641,503

[45] Date of Patent: Feb. 10, 1987

[54] OUTDOOR UNIT FOR AN AIR CONDITIONING APPARATUS OF THROUGH-THE-WALL MULTITYPE

[75] Inventor: Tadashi Kobayashi, Urawa, Japan

[73] Assignee: Daikin Industries Ltd., Osaka, Japan

[21] Appl. No.: 809,874

[22] Filed: Dec. 17, 1985

[30] Foreign Application Priority Data

Jan. 19, 1985 [JP] Japan ..... 60-5947[U]

[51] Int. Cl.[4] ..... F25D 23/12

[52] U.S. Cl. ..... 62/259.1; 62/263; 62/448

[58] Field of Search ..... 62/259.1, 448, 499, 62/524, 525, 526, 262, 263

[56] References Cited

U.S. PATENT DOCUMENTS

| | | | |
|---|---|---|---|
| 2,807,940 | 10/1957 | Urban | 62/524 X |
| 3,123,987 | 3/1964 | Moore | 62/263 |
| 3,464,228 | 9/1969 | Hitchcock | 62/448 X |
| 3,507,322 | 4/1970 | Tetrick et al. | 62/448 X |
| 3,611,743 | 10/1971 | Manganaro | 62/263 |
| 3,740,964 | 6/1973 | Herweg | 62/448 X |
| 4,123,919 | 11/1978 | Fehlhaber | 62/259.1 X |
| 4,138,859 | 2/1979 | Pietsch | 62/259.1 X |

*Primary Examiner*—Lloyd L. King

*Attorney, Agent, or Firm*—Birch, Stewart, Kolasch & Birch

[57] ABSTRACT

An outdoor unit for an air conditioning apparatus of a through-the-wall multitype which is installed within an installation opening formed through the wall of a room so as to conduct heat exchange of outdoor coils outside the room whereby connection of piping between the outdoor unit and indoor units is easily performed inside the room.

7 Claims, 6 Drawing Figures

OUTDOOR UNIT FOR AN AIR CONDITIONING APPARATUS OF THROUGH-THE-WALL MULTITYPE

BACKGROUND OF THE INVENTION

1. Field of the Invention

The present invention relates to an outdoor unit for an air conditioning apparatus of the so-called multitype arranged for conditioning a plurality of rooms with one outdoor unit connected to indoor units corresponding in number to the number of the rooms to be air conditioned. An essential object of the present invention is to provide an improved outdoor unit of an air conditioning apparatus for the through-the-wall multitype which is installed within an installation opening formed piercing through a wall of the room so as to conduct heat exchange with outdoor coils located outside the room, whereby connection of piping between the outdoor unit and indoor units can be easily performed inside the room.

2. Description of the Prior Art

In a conventional air conditioner of the multi-type construction as described above, the outdoor unit is placed on the floor of a veranda or the like, while being connected to the indoor units through connection pipes which are led through a through-hole formed in the wall. Therefore, the conventional air conditioner has a disadvantage in that it cannot be installed in a room of a high building without a veranda since the outdoor unit cannot be placed outside the building.

SUMMARY OF THE INVENTION

Accordingly, the present invention has been developed with a view to substantially eliminate the above-described disadvantage inherent in the conventional air conditioner. An essential object of the present invention is to provide an improved air conditioning apparatus of the through-the-wall multitype enabling the installation of the outdoor unit thereof in a wall inside a room in the case where there is no space for the outdoor unit to be placed outside the room.

Specifically, in accordance with a preferred embodiment of the present invention, there is provided an improved outdoor unit for an air conditioning apparatus of the through-the-wall multi-type which is able to be installed in the installation opening formed through the wall of the room that connects the inside and the outside of the room. The outdoor unit is connected to a plurality of indoor units placed in each room of a building. The outdoor unit comprising a casing secured to the installation opening in the wall and provided with a covering for coverage of the front opening thereof, a bottom plate provided with a partition plate which is accommodated within the casing in such a manner that it is freely taken in and out of the casing from the front opening thereof and which divides the bottom plate at the center thereof into front and rear parts, electrical equipment and pipe connection joints connecting the connection pipes mounted on said bottom plate in the front part thereof, outdoor coils, a fan and components for a cooling medium circuit all of which are mounted on said bottom plate in the rear part divided by the partition plate. A ventilator grille is provided on the rear face or on the side face of the casing which protrudes outside the room from the wall face so as to circulate the air into the outdoor coils. An outlet is formed for the connection pipes on the front face or on the side face of the casing facing the inside of the room from the wall face, thereby accomplishing the above-expected object with simple construction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become apparent from the following description taken in conjunction with the preferred embodiment thereof with reference to the accompanying drawings, in which.

DESCRIPTION OF THE PREFERRED EMBODIMENT

Figure 1:
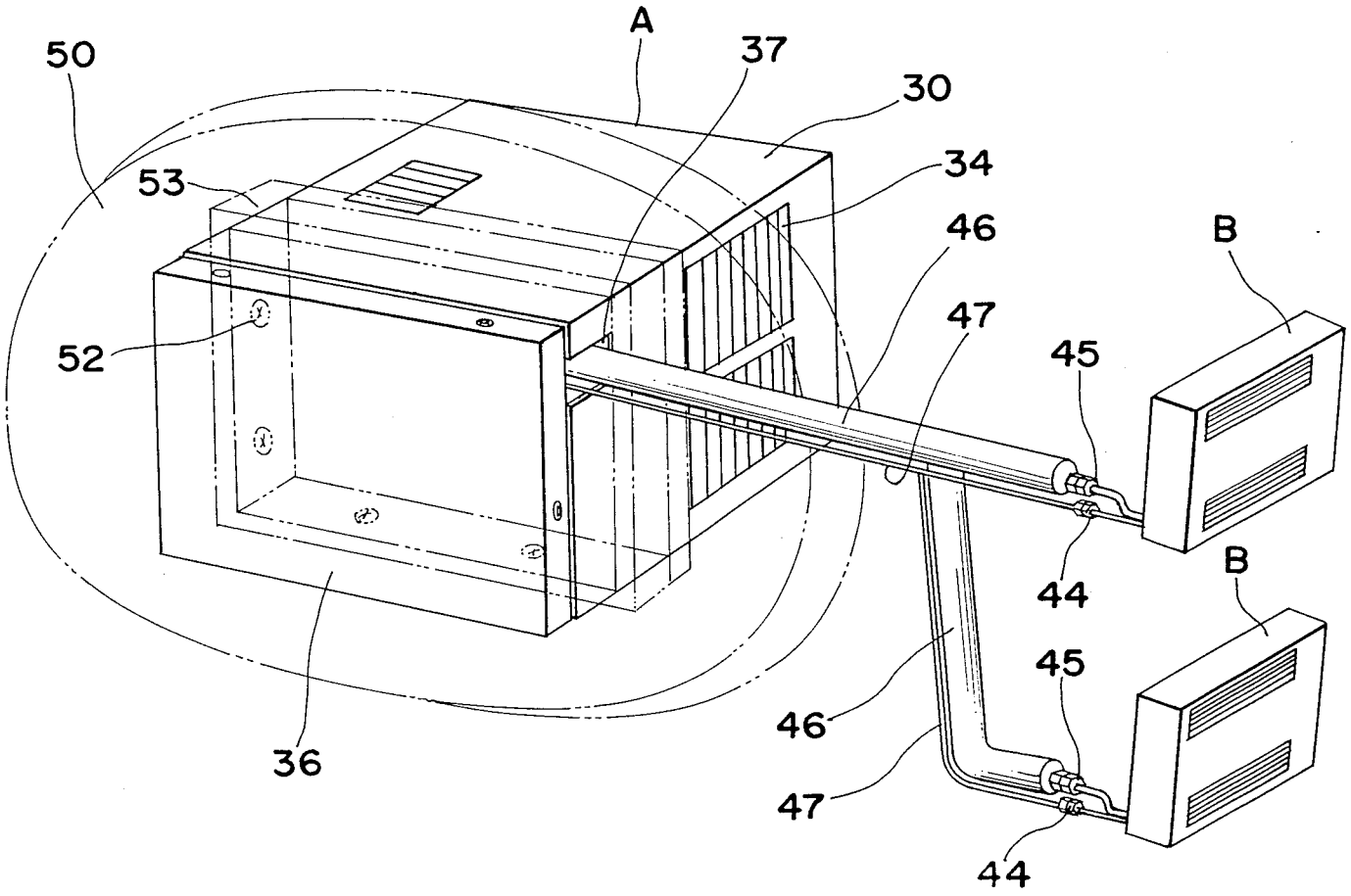
FIG. 1 is a schematic perspective view showing the external appearance of parts of an air conditioning apparatus including an outdoor unit in accordance with the preferred embodiment of the present invention.

Before the description of the present invention proceeds, it is to be noted that like parts are designated by like reference numerals throughout the accompanying drawings.

Referring now to the drawings, all components of the air conditioning apparatus according to the present invention will be shown and described hereinafter with reference to the cooling medium circuit block diagram of FIG. 6. Also, in the drawings, the air conditioning apparatus has one outdoor unit A connected to two indoor units B and B. However, the number of the indoor units B to be connected to the outdoor unit A can be selected within the range of the number of pipe connecting joints the outdoor unit A is furnished with, and accordingly, the air conditioning apparatus shown in the drawings constitutes an air conditioning apparatus of the so-called multi-type.

Figure 3:
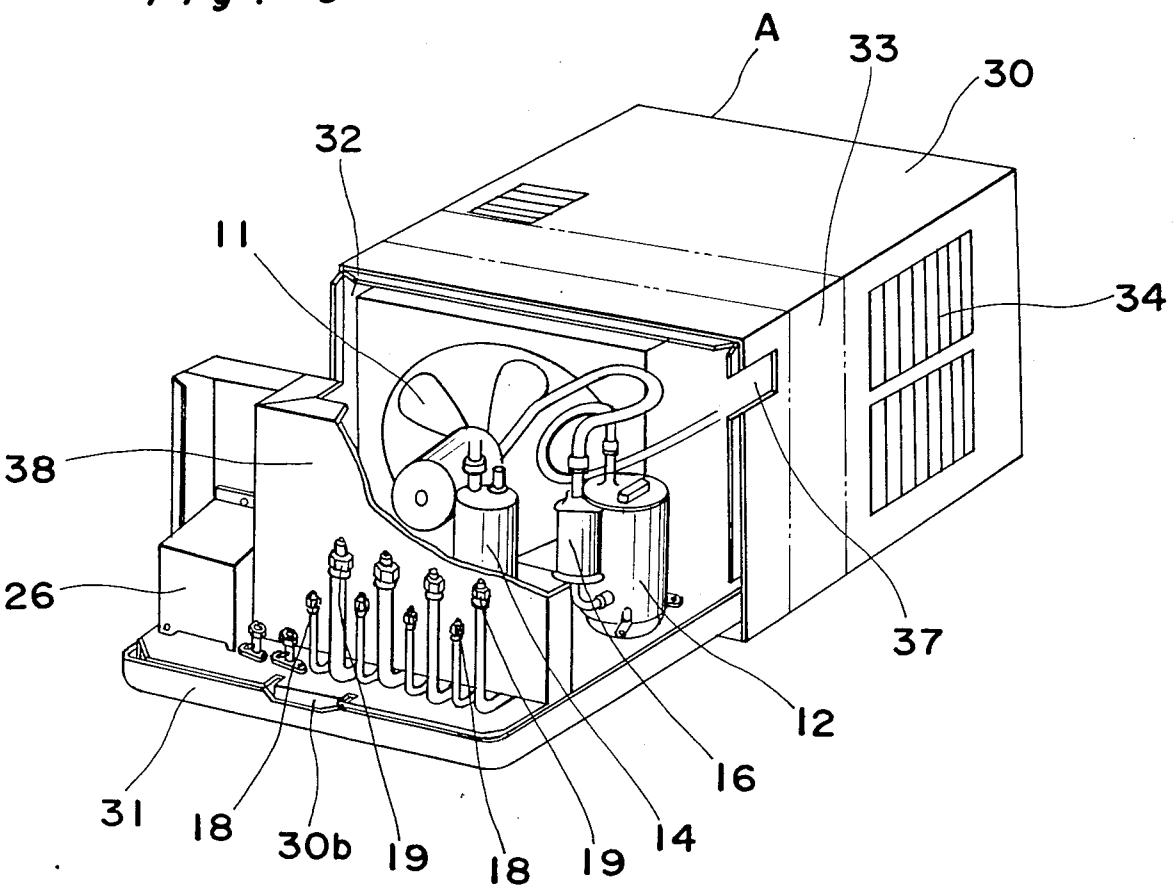
FIG. 3 is a perspective view showing the outdoor unit of FIG. 2, with a chassis of parts partially removed from the casing.

The above outdoor unit A is equipped with components sufficient to supply cooling medium to all of the indoor units B connectable to the outdoor unit A, while each of the indoor units B is provided with components enabling compulsory heat-exchange in each of the rooms. The respective components of the outdoor unit A and the indoor units B are as illustrated in FIGS. 3, 4 and 6.

Figure 4:
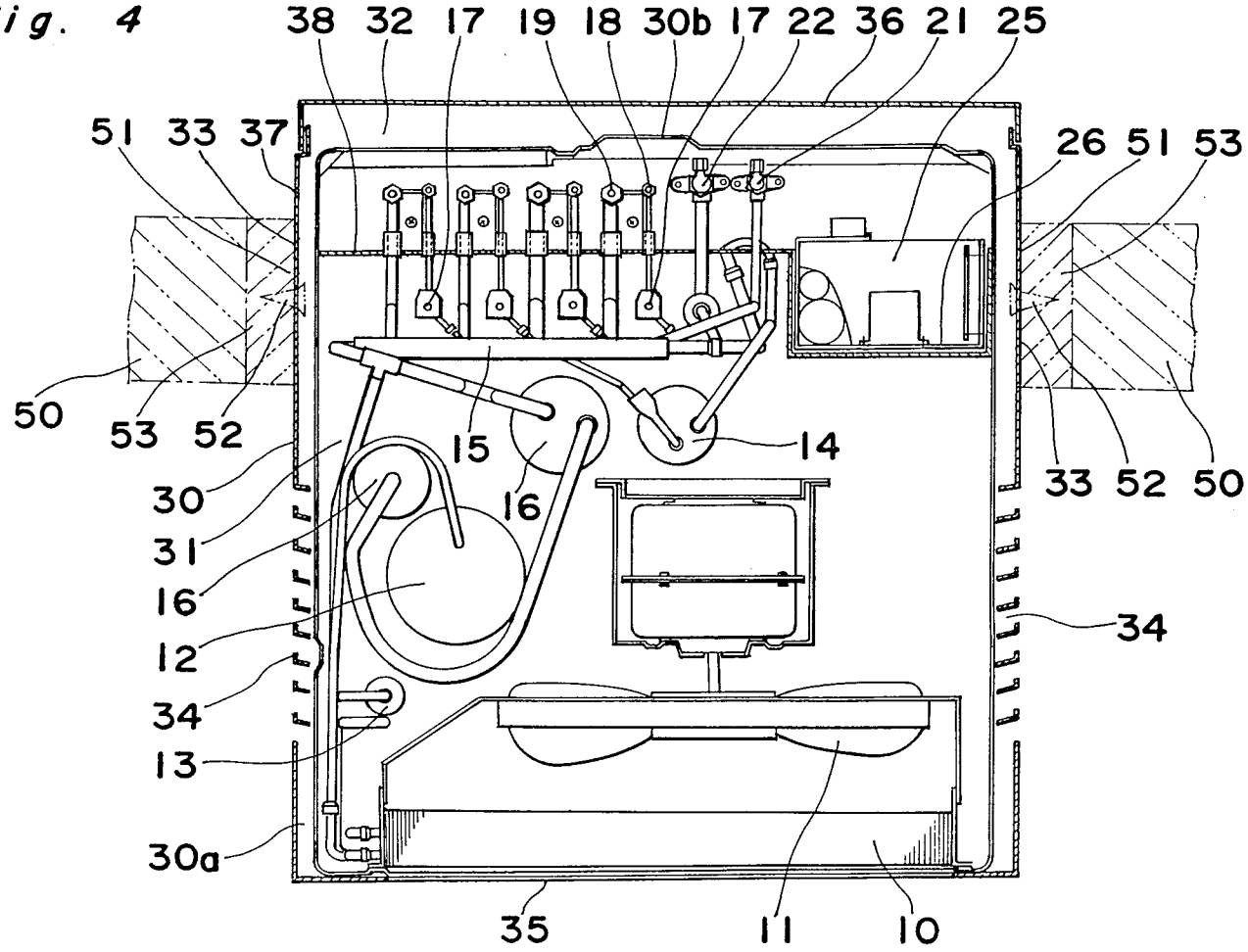
FIG. 4 is a top cross-sectional view of the outdoor unit shown in FIG. 1.
Figure 6:
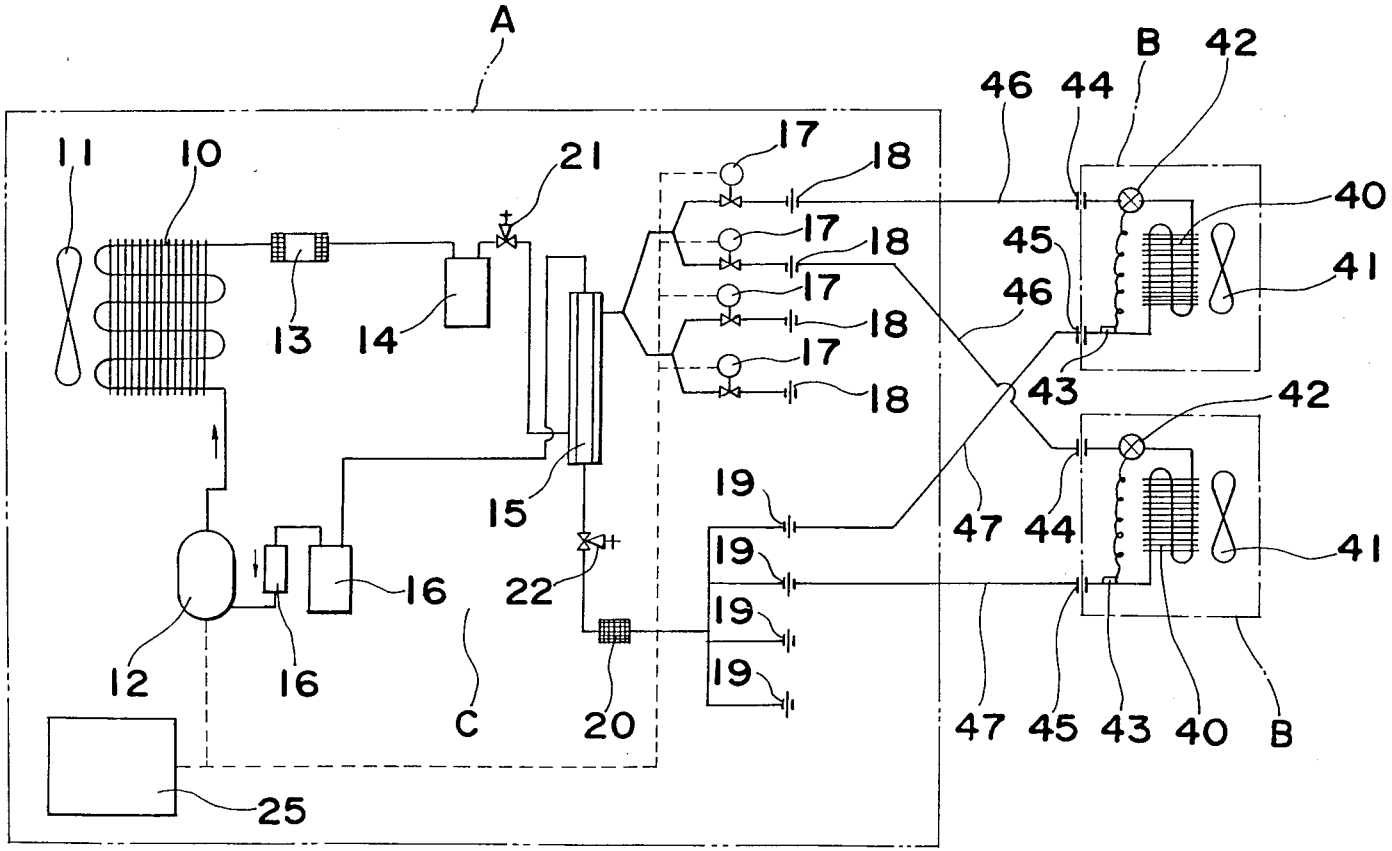
FIG. 6 is a cooling medium circuit block diagram employed in the air conditioning apparatus of FIG. 1.

Referring to FIGS. 4 and 6, the circuit construction of a cooling medium circuit with respect to the outdoor unit A includes outdoor coils (condenser) 10, an outdoor fan 11, a compressor 12 as a component for the cooling medium circuit, a dryer filter 13, a liquid receiver 14, a liquid suction gas heat exchanger 15, an accumulator 16, four electromagnetic valves 17, four pipe connecting joints 18 at the liquid side, four pipe connecting joints 19 at the gas side, a filter 20, and closing valves 21 and 22 for enclosure of the cooling medium. As is well known to those skilled in the art, the cooling medium is forcibly circulated by actuation of the compressor 12 from the pipe connecting joints 19 for the gas through the filter 20, the closing valve 22, the liquid suction gas heat exchanger 15, the accumulator 16, the compressor 12, the outdoor coils 10, the dryer filter 13, the liquid receiver 14, the closing valve 21, the liquid suction gas heat exchanger 15, the electromagnetic valves 17 to the pipe connecting joints 18 for the liquid. Before the outdoor unit A is connected to the indoor units B, both of the closing valves 21 and 22 are closed to enclose the cooling medium in respective circuits at the side of the compressor 12. Then, after the outdoor unit A is connected to the indoor units B, each of the closing valves 21 and 22 is opened so as to let the cooling medium circulate within the whole circuit.

On the other hand, the circuit construction for the cooling medium circuit with respect to the indoor unit B includes indoor coils 40, an indoor fan 41, an expansion valve 42, a temperature sensor 43, a pipe connecting joint 44 at the liquid side and a pipe connecting joint 45 at the gas side. When the pipe connecting joint 44 for the liquid side and the pipe connecting joint 45 for the gas side are respectively connected, through a connecting pipe 46 for the liquid side and a connecting pipe 47 for the gas side, to the pipe connecting joint 18 for the liquid side and the pipe connecting joint 19 for the gas side, the cooling medium is able to be circulated, through the integral actuation with the above outdoor unit A, from the pipe connecting joint 44 for the liquid side through the expansion valve 42 through the indoor coils 40 to the pipe connecting joints 45 for the gas side.

Figure 2:
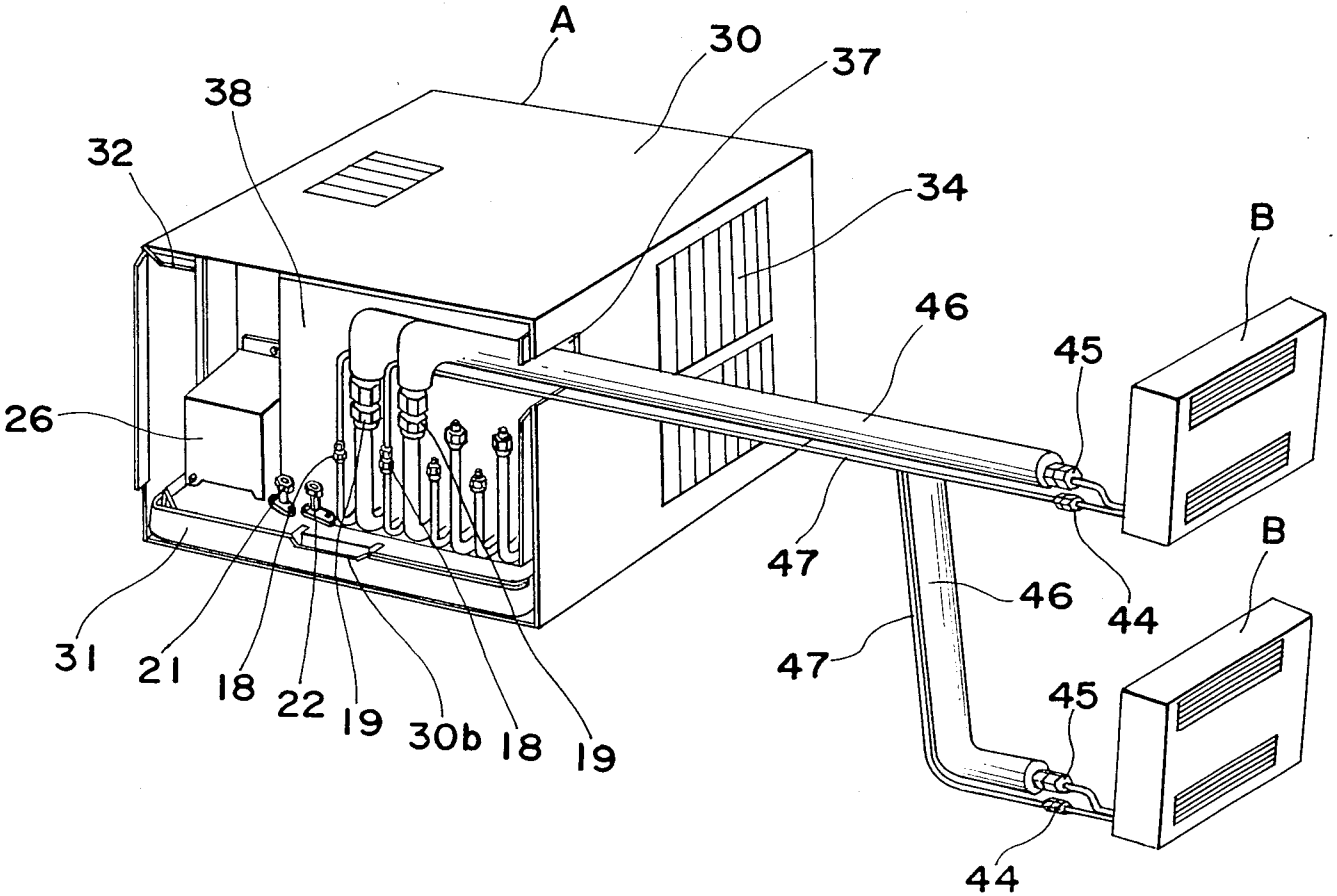
FIG. 2 is a perspective view similar to FIG. 1, showing a cover removed from the casing of the outdoor unit.

Each component constituting the circuit of the outdoor unit A as described above is, as shown in FIGS. 3 and 4, mounted on a bottom plate 31 which is accommodated within a casing 30 in such a manner that it can be freely taken in and out of the casing. The casing 30 of the outdoor unit A of a square chest-like configuration has a mouth portion 32 formed in the front face thereof, an installation panel 33 formed in the front part of the side faces thereof and ventilator grilles 34 and 35 for ventilation of air formed in the rear face and in the rear part of the side faces thereof, with a covering 36 being provided at the mouth portion 32 for protection of the same in such a manner as to be freely attached to and detached from the casing 30. The external form of the casing 30 is so determined that the casing can be fully inserted into an installation opening 51 formed in the wall face 50 and leading to the outside of the room. An outlet 37 for pipes connected to the indoor coils is formed in the portion of the casing 30 protruding from the wall face 50 to the inside of the room when the casing 30 is put into the installation opening 51, that is, in the front face or in the front part of one side face of the casing facing towards the inside of the room. It is to be noted that this outlet 37 may not be formed at the time when the casing 30 is processed, but may be formed in the casing 30 just before the outdoor unit A is inserted for fixing into the installation opening 51. The bottom plate 31 in the form of a tray is accommodated in the casing 30 which is removed with the covering 36 such that it is fixedly placed at a predetermined position on a bottom floor 30*a* of the casing 30, with a handle 30*b* being provided in the front part thereof, and on the other hand, the bottom plate 31 has a partition plate 38 standing in the central front portion on the upper face of the bottom plate so that the room over the bottom plate is divided into rear and front parts. Moreover, the outdoor coils 10, the fan 11 and the components C for the cooling medium circuit are mounted on the bottom plate 31 behind the partition plate 38, whereas the electrical equipment 25, the pipe connecting joints 19 for the gas side and the pipe connecting joints 18 for the liquid side to be connected to the indoor units B are mounted on the bottom plate 31 in front of the partition plate 38. As shown in FIGS. 3 and 4, the circuit components C for the cooling medium circuit and the connection joints 18 and 19 are, while being separated by the partition plate 38, located adjacent the partition plate 38 respectively. The outdoor coils 10 are provided in the rear part of the bottom plate 31. The actuation of the fan 11 provided in front of the outdoor coils 10 brings the air to pass through the outdoor coils 10 from the ventilator grille 34 thereby to cool the outdoor coils 10. Thereafter, the air is discharged out of the casing from the ventilator grille 35. The connection joints 18 and 19 are, as shown in FIG. 2, arranged in front of the partition plate 38 for easy access when the covering 36 is removed from the casing 30, and consequently, when the connection joints 18 and 19 are connected to the connection pipes 47 and 46 of the indoor units B, the connection pipes 46 and 47 can be easily drawn out of the outlet 37.

The electric parts 25 include ON-OFF control switches for the electromagnetic valves 17 and a motor for the fan 11, a motor for the compressor 12 etc., all of which are contained in an electrical box 26 placed in the front of the partition plate 38 on the bottom plate 31 in such a position that it can be easily handled when the covering 36 is taken off from the casing 30.

Figure 5:
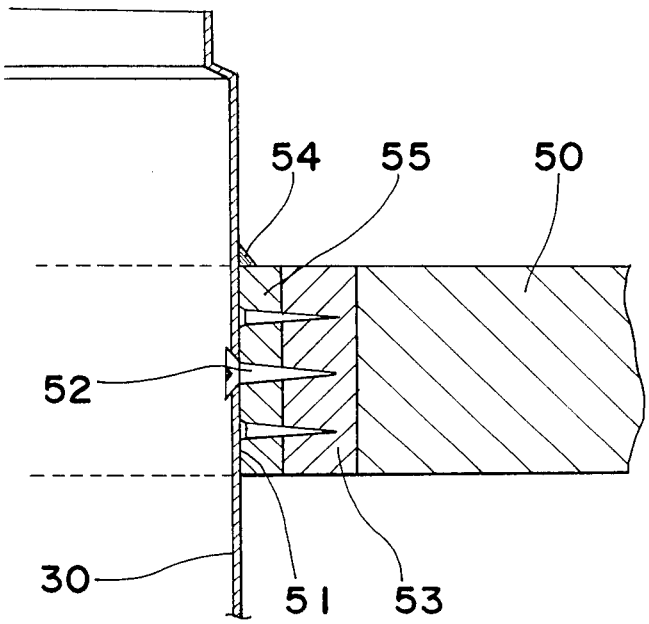
FIG. 5 is a cross-sectional view, on an enlarged scale, showing a portion of the outdoor unit of FIG. 1 fixedly installed within a hole of a building wall.

When the outdoor unit A having the construction as described above is to be installed, only the casing 30 is first inserted into the installation opening 51 formed on the wall 50, and then the installation panel 33 facing the wall surface 50 is secured to a wooden frame 53 which is preliminarily fixed to the wall surface 50 by an installation fixture 52 as shown in FIG. 5. Thereafter, the outer side surface of the casing 30 is adhered to the wooden frame 53 by a putty 54 for sealing therebetween. The wooden frame 53 is preliminarily fixed to the peripheral inner surface of the installation opening 51 formed on the wall face 50 of the room. If there is a large gap between the wooden frame 53 and the casing 30, another wooden frame 55 is attached for adjustment of the wooden frame 53 fixedly inserted into the installation opening 51. Both wooden frames 53 and 55 are secured to the casing 30 by the fixture 52. Into the casing 30, which is fixed to the installation opening 51 in the wall face 50 in the manner as described above, the bottom plate 31 with the outdoor coils 10, the fan 11, the components C for the cooling medium circuit, the electrical equipment 25 and the pipe connecting joints 18 and 19 mounted thereon is inserted to be placed at a predetermined position. Then the pipe connecting joints 18 and 19 are connected respectively to one end of the connection pipes 46 and 47, the other ends thereof being connected to the pipe connection joints 44 and 45 of the indoor unit B. Subsequently, the pipes 46 and 47 are led out of the casing 30 through the outlet 37, and at the same time, the power cord (not shown) from the electrical equipment 25 is connected to a power source, with the front mouth portion 32 being covered by the covering 36. Thus, the air conditioning apparatus is brought into an operable state.

As is fully described in the foregoing embodiment, an outdoor unit for an air conditioning apparatus of a through-the-wall multitype according to the present invention which is able to be installed in an installation opening formed through the wall. The outdoor unit is connected, through connection pipes, to a plurality of indoor units placed in each of the rooms of a structure. The outdoor unit is comprised of a casing which is fixed to the installation opening in the wall face and covered by a covering at the front mouth portion thereof, said covering being freely attached to and detached from the casing. A bottom plate is provided with a partition plate for dividing the bottom plate into rear and front parts, said partition plate being freely accommodated into and out of said casing from said front mouth portion of the casing. Electrical equipment and pipe connection joints for connecting said connection pipes are both mounted on said bottom plate in the front part thereof and outdoor coils, a fan and cooling medium circuit components are all mounted on said bottom plate in the rear part divided by the partition plate. A ventilator grille is formed on the rear face or on the side face of the casing which protrudes outside the room from the wall surface so that the air is circulated into the outdoor coils. An outlet for said connection pipes is formed on the front face or on the side face of the casing facing the inside of the room from the wall surface.

Accordingly, the outdoor unit according to the present invention installed in the installation opening on the wall surface can be easily connected to indoor units inside the room through pipes and wirings. At the same time, the components for the cooling medium circuit can be freely feed out into the inside of the room for repairing, etc.. Therefore, the outdoor unit of the present invention is advantageous in that it can be installed in the wall surface for easy access such that the outdoor unit can be connected to indoor units from the inside of the room even when there is not spare space for installation of the outdoor unit on a veranda or the like conventionally used for installation, thereby contributing to an expansion of uses of the air conditioning apparatus of this type.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An air conditioning apparatus comprising an outdoor unit for mounting within an opening extending from an interior wall to an exterior wall of a building and at least one indoor unit for mounting within a room of the building, said outdoor unit comprising:

an outdoor unit casing, having a front portion and a rear portion, for mounting within the opening extending from an interior wall to an exterior wall of a building;

a tray removably provided within said casing;

a sectioning means provided on said tray for sealing said forward portion from said rearward portion of said casing;

an outdoor unit air conditioning means for controlling and changing the temperature of a circulation fluid that is circulated to said at least one indoor unit, said outdoor unit air conditioning means is provided in the rear portion of said casing, said outdoor unit air conditioning means is supported by said tray;

an electrical control means for controlling the operation of said outdoor unit air conditioning means, said electrical control means is provided in the front portion of said casing, said electrical control means is supported by said tray;

an outdoor unit connection means for releasably coupling said outdoor unit air conditioning means of said outdoor unit to said at least one indoor unit, said outdoor unit connection means is provided in the front portion of said outdoor unit casing, said outdoor unit connection means is supported by said tray;

a front cover means, at least partially removable from said outdoor unit casing, for providing an individual quick and easy access to said forward portion of said outdoor unit for releasably coupling said outdoor unit to said at least one indoor unit by means of said outdoor unit connection means, for allowing the individual quick and easy access to said electrical control means, and for providing an opening in said outdoor casing for removal of said tray supporting said outdoor unit air conditioning means, said electrical control means and said outdoor unit connection means as a unit.

2. The air condition apparatus according to claim 1, wherein said at least one indoor unit comprises:

an indoor unit casing;

an indoor unit connection means for coupling said at least one indoor unit to said outdoor unit connection means; and an indoor unit air conditioning means for receiving the temperature controlled circulation fluid from said outdoor unit air conditioning means for controlling the temperature and humidity of the air located within an interior space of a building.

3. The air conditioning apparatus according to claim 1, wherein said outdoor unit connection means includes a plurality of individual valves that can be actuated on, partially on, and off for controlling the flow of circulation fluid between said outdoor and at least one indoor unit.

4. The air conditioning apparatus according to claim 2, wherein said outdoor unit connection means includes a plurality of individual valves that can be actuated on, partially on, and off for controlling the flow of circulation fluid between said outdoor and at least one indoor unit.

5. The air condition apparatus according to claim 1, wherein said outdoor unit air condition means includes heat exchange coils, fan and fluid compressor.

6. The air condition apparatus according to claim 4, wherein said outdoor unit air condition means includes heat exchange coils, fan and fluid compressor.

7. The air conditioning device of claim 1 in which said outdoor connection means includes a plurality of individual valves controlled by said electrical control means for selectively controlling the fluid flow through each individual valve.

* * * * *